US006286188B1

(12) United States Patent
Müller et al.

(10) Patent No.: US 6,286,188 B1
(45) Date of Patent: Sep. 11, 2001

(54) REGULATED DRAWING FRAME

(75) Inventors: Christian Müller, Wallenwil; Jürg Faas, Andelfingen; Beat Näf, Jona; Christian Grieshammer, Winterthur; Theodore Götz Gresser, Winterthur, all of (CH)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 09/486,732

(22) PCT Filed: Aug. 31, 1998

(86) PCT No.: PCT/IB98/01357

§ 371 Date: Aug. 21, 2000

§ 102(e) Date: Aug. 21, 2000

(87) PCT Pub. No.: WO99/11847

PCT Pub. Date: Mar. 11, 1999

(30) Foreign Application Priority Data

| | | |
|---|---|---|
| Sep. 1, 1997 | (DE) | 197 38 053 |
| Nov. 24, 1997 | (CH) | 2711/97 |
| Jul. 23, 1998 | (CH) | 1560/98 |

(51) Int. Cl.[7] ..... D01H 5/32
(52) U.S. Cl. ..... 19/239; 19/65 A; 19/236
(58) Field of Search ..... 19/65 A, 98, 236, 19/237, 238, 239, 240, 258, 260

(56) References Cited

U.S. PATENT DOCUMENTS

| | | | | |
|---|---|---|---|---|
| 3,403,426 | * | 10/1968 | Stiepel et al. | 19/236 |
| 3,703,023 | | 11/1972 | Krauss et al. . | |
| 4,100,649 | | 7/1978 | Erismann et al. . | |
| 4,271,565 | | 6/1981 | Grunder . | |

(List continued on next page.)

FOREIGN PATENT DOCUMENTS

| | | |
|---|---|---|
| 462 682 | 10/1968 | (CH) . |
| 1 919 929 | 11/1970 | (DE) . |
| 2 230 069 | 1/1973 | (DE) . |
| 40 41 719 A1 | 6/1992 | (DE) . |
| 296 22 923 | 9/1997 | (DE) . |
| 0 617 149 | 2/1994 | (EP) . |
| 0 627 509 | 12/1994 | (EP) . |
| 0 643 160 | 5/1997 | (EP) . |
| 0 799 916 | 10/1997 | (EP) . |
| 1 288 475 | 9/1972 | (GB) . |
| 1 537 531 | 12/1978 | (GB) . |
| 51-29529 | 3/1976 | (JP) . |
| 51-70268 | 6/1976 | (JP) . |
| 51-136601 | 10/1976 | (JP) . |

OTHER PUBLICATIONS

Page 72 Of "Abbreviated Cotton Spinning" Noted On Page 10 of The Substitute Specification.

PCT Search Report, Nov. 27, 1998.

*Primary Examiner*—John J. Calvert
*Assistant Examiner*—Gary L. Welch
(74) *Attorney, Agent, or Firm*—Dority & Manning

(57) ABSTRACT

The present invention concerns a drafting system (30) with a drive (M2) provided with a regulating device (M3, 33) for levelling out mass variations in a fiber mass (6) supplied to the drafting system by a supply source (1). The mass variations are detected by at least one measuring sensor (70) coordinated to the drafting system and the corresponding signals are transmitted to a control unit (S). A further device (11, 12, 62, 63) may be coordinated to the drafting system (30) which is suitable for detecting differences between the delivery speed of the supply source (1) and the intake speed of the drafting system (30) and apply it for influencing the base rotational speed of the drafting system or to detect long term mass variations from a predetermined desired value in which arrangement these mass deviations detected are applied for influencing the base rotational speed of the drafting system.

22 Claims, 5 Drawing Sheets

U.S. PATENT DOCUMENTS

| | | | | |
|---|---|---|---|---|
| 4,512,061 | * | 4/1985 | Hartmannsgruber et al. | 19/239 |
| 4,768,262 | | 9/1988 | Gunter . | |
| 4,947,947 | | 8/1990 | White . | |
| 4,974,296 | | 12/1990 | Vidler . | |
| 4,982,477 | | 1/1991 | Hosel . | |
| 5,014,395 | | 5/1991 | Staheli et al. . | |
| 5,018,248 | * | 5/1991 | Haworth et al. | 19/240 |
| 5,152,033 | | 10/1992 | White . | |
| 5,161,284 | * | 11/1992 | Leifeld | 19/260 |
| 5,233,728 | | 8/1993 | Whiteley et al. . | |
| 5,274,883 | | 1/1994 | Eke . | |
| 5,377,385 | * | 1/1995 | Jornot et al. | 19/240 |
| 5,384,934 | * | 1/1995 | Dammig | 19/239 |
| 5,388,310 | | 2/1995 | Haworth et al. . | |
| 5,394,591 | * | 3/1995 | Jornot et al. | 19/240 |
| 5,400,476 | | 3/1995 | White . | |
| 5,412,301 | * | 5/1995 | Jornot et al. | 19/239 |
| 5,428,870 | * | 7/1995 | Rutz et al. | 19/240 |
| 5,438,733 | * | 8/1995 | Melcher et al. | 19/260 |
| 5,461,757 | * | 10/1995 | Leifeld | 19/239 |
| 5,528,798 | | 6/1996 | Strobel et al. . | |
| 5,535,488 | | 7/1996 | Yao et al. . | |
| 5,544,390 | * | 8/1996 | Hartung et al. | 19/240 |
| 5,713,106 | * | 2/1998 | Dammig | 19/240 |
| 5,771,542 | * | 6/1998 | Dammig | 19/239 |
| 5,774,942 | * | 7/1998 | Clapp et al. | 19/239 |
| 5,774,943 | * | 7/1998 | Clapp et al. | 19/240 |
| 5,796,220 | * | 8/1998 | Clapp et al. | 19/258 |
| 5,815,889 | * | 10/1998 | Barth et al. | 19/240 |
| 5,839,165 | * | 11/1998 | Patelli et al. | 19/260 |
| 5,943,740 | * | 8/1999 | Slavik et al. | 19/239 |
| 5,991,977 | * | 11/1999 | Weber | 19/236 |
| 6,088,882 | * | 7/2000 | Leifeld | 19/239 |

* cited by examiner

REGULATED DRAWING FRAME

BACKGROUND

The present invention relates to a drafting system with a drive arrangement with a regulating device for regulating mass variations in a fibre mass supplied from a supply source to a drafting system in which arrangement the mass variations are detected by at least one measuring device coordinated to the drafting system and transmitted to a control unit.

In practice regulating drafting systems are known form the following publications:

JP-Gbm-5017/78 Nihon Keikzai KK

JP-A-155231/177 Nagoya Kinzoku Harinuno KK

DE-A-1931929 Zinser

DE-A-2230069 Texcontol

CH-B-599993 Graf

EP-C-354653 Hollingsworth

EP-A-544425 Hollingsworth

EP-A-604137 Hollingsworth

EP-A-617149 Grossenheiner Textilmaschinenbau GmbH

EP-A-643160 Howa Machinery, Ltd

EP-A-692560 Chemnitzer Spinnereimaschinenbau GmbH

US-B-5400476 Myrick-White, Inc.

A conventional card operates at a constant (pre-settable) production rate, i.e. the fibre sliver is delivered at a predetermined speed from the delivery arrangement The function of a regulating drafting system implies that the draft is variable (controllable). Provision of a large sliver storage device between the card delivery system must be variable. This, however, creates problems concerning the drive for the sliver deposition or coiler system, the inertia of which is relatively considerable, arranged downstream from the drafting system.

Various devices are known, e.g. from the DE-OS-19 19 929, in which arrangement sliver storage device is arranged between the card and a regulating drafting system. This can be seen in particular in the FIGS. 3 and 4 of the DE-OS reference. Adjoining the regulating drafting system a sliver storage device is arranged driven by a separate motor. The measured values determined by the pair of measuring rolls upstream from the regulating drafting system are compared to the preset desired values. The resulting deviation signal serves for controlling the drive motor for the intake pair of rolls of the drafting system in order to adapt the draft ration, and to level out thin and thick places respectively. At the same time, this signal transmitted to the control device for the drive of the fibre sliver source, or of the card respectively, in such a manner that this drive also can be adapted correspondingly. The reaction of the card however, is subject to substantially higher inertia than the drafting system. The resulting differences in the material delivery, and in the material intake respectively, are leveled out in the sliver storage device adjoining the card. The storage device in this arrangement is provided with sensors for scanning the contents of the storage device. Based on the contents determined by the sensors in the sliver storage device, the drives of the fibre sliver source (card) and of the fibre sliver take-up device (coiler) are changed accordingly in such a manner that the contents of the fibre sliver storage device is maintained substantially constant. This adaptation of the two drives however, results in additional differences, especially as the elements of the card (e.g. the card main drum) are subject to different inertia influences other that the elements of the sliver depositing device (coiler).

Furthermore, from the previously published DE-A1-44 24 490 a co-ordination of cards is known in which a storage device is coordinated to each card downstream and in which the card slivers delivered by the individual storage devices after passing through a drafting system are delivered to a common sliver deposition device or coiler. In order to compensate for the loss of one of the card slivers supplied to the drafting system the delivery speed of the drafting system is reduced until the missing card sliver has been re-inserted. In this arrangement, a scanning sensor is coordinated to each individual card sliver. Owing to the reduction in delivery speed, corresponding to the loss of one card sliver, the fibre sliver reserve for the draw frame is exhausted more slowly than in the normal operating mode at higher intake speeds. In the example shown, an increase of the card delivery speed also is proposed if the fibre sliver storage device arranged downstream is depleted in excess of a predetermined value in such a manner that the operation of the subsequent draw frame is not jeopardized. The arrangement shown is suitable for levelling out massive short term variation (loss of sliver). Levelling out long term deviations however, is not envisaged using this arrangement, or is solved unsatisfactorily only.

For levelling out long period mass deviations in the fibre sliver delivered by the card it is proposed in DE-A1 29 12 576 that the thickness of the fibre sliver delivered by the card be measured and compared to a pre-set desired value. The signal thus determined is used in controlling the material supply device (feed roll) arranged upstream from the card. Owing to this arrangement, long period deviations in the mass of the card sliver delivered can be reacted on. Avoiding and eliminating of short wave deviations e.g. using a regulated drafting system is not envisaged in the arrangement described. The action in the control of the drive of the feed roll for compensating for long period mass deviations becomes effective, however, only after a major time delay.

The solutions proposed thus far generally provide the drafting system for levelling out short term variations in the fibre sliver. The correspondingly propose application of a measuring sensor at the intake of the drafting system.

Similar problems are encountered on other machines also, e.g. on the combing machine, if directly downstream from a textile processing unit a regulated drafting system is arranged which is driven at a regulated variable intake speed.

SUMMARY OF THE INVENTION

It thus is a goal of the present invention to proposed an apparatus which eliminates the problems described above in order to create a straightforward and functioning combination of a textile processing unit operating at essentially constant speed (supply source) with a subsequently arranged regulated drafting system unit. Additional objects and advantages of the invention will be set forth in the following description, or may be obvious from the description, or may be learned through practice of the invention. According to the invention, at least one further means is coordinated to the drafting system which is suitable to detect a regulating action on the drive of the drafting system required for maintaining a predetermined desired rotational speed before or during the regulating action and to apply it for influencing the base rotational speed of the drafting system.

Owing to this arrangement, the capacity of a storage device possibly required between the textile processing machine and the regulated drafting system arranged subsequently can be kept relatively small as the regulating actions are compensated for by adapting the base rotational speed of the drafting system. Furthermore, a security device is created which ensures that the drive rotational speed (base rotational speed) does not drift from a base setting.

The further means preferably is suitable to detect differences between the delivery speed of the supply source and the intake speed of the drafting system. The difference in speed results from the change in the rotational speed of the regulated roll of the drafting system.

The further means also can be suited for detecting long term mass variations relative to a pre-set desired value.

Preferentially, the further means is a fibre sliver storage device which can be equipped with corresponding sensor elements. Using said sensors, the differences in the transporting speed of the fibre sliver can be detected, which are caused by the variable and regulated take-off speed of the intake pair of rolls of the drafting system un it on the basis of the variable filing degree in the storage device, and the base rotational speed of the drafting system can be acted upon. Thus a pre-control is effected which ensures that the degree of filling of the storage device can be kept to a low level.

The fibre sliver storage device can be laid out as a sliver sag storage device in which arrangement the sagging of the fibre sliver loop can be continuous or discontinuous.

Furthermore, provision of an additional sensor is proposed for detecting the fibre mass which can be arranged directly adjoining the delivery of a textile material processing unit arranged upstream from the drafting system. Using this arrangement, long term mass deviations can be detected at a very early stage and thus corresponding action upon the base rotational speed of the drafting system arranged downstream can be effected.

The textile processing unit in this arrangement can be a card, in which arrangement the sensor provided at the delivery device of the card at the same time can be applied in a long term regulation of the feed device of the card.

The further means also can consist of a sensor device for scanning the rotational speed of the regulated pair of rolls of the drafting system and of at least one pair of transporting rolls for the fibre mass rotating at constant speed, in which arrangement the ratio of rotational speeds serves for determining the long term mass deviation, based on which corresponding action upon the base rotational speed of the drafting system can be effected.

As a further possibility, it is proposed that the supply source consists of at least two coordinated cards arranged parallel in which arrangement the drive of the second card via the control device is adapted to the drive of the first card, and that the fibre material delivered by the respective cards is detected by a sensor each and that the averaged signal generated by the two sensors is applied for acting upon the base rotational speed of the drafting system. In this manner, on one hand synchronisation of the two cards and on the other hand the combined supply of the fibre slivers generated to a common drafting system are ensured in which arrangement fibre slivers generated to a common drafting system are ensured in which arrangement fibre sliver storage devices, as proposed further, can be laid out in a small and compact arrangement. Advantageously the fibre sliver storage can be equipped with a scanning device.

The scanning device for the fibre sliver storage device of the second card, the drive of which is coordinated to the one of the first card, or the slave card, can be applied for overriding the control link of the two card drives. This makes it feasible to compensate for short term deviations in the production of the second card. Expressed in other words, the drive of the take-off roll of the second card is regulated until the fibre sliver loop in the fibre sliver storage device is brought back to within the sagging tolerance limits. This overriding action can be limited in time, i.e. in case of a longer duration of a deviation detected it is assumed a defect has occurred and the machines are brought to a standstill for inspection.

As scanning sensors, sag sensors can be applied which scan the sagging of the fibre slivers in the fibre sliver storage device continually or discontinuously.

It is proposed furthermore that downstream from the drafting system unit a sliver depositing device or coiler is arranged and that the draft applied in the drafting unit is so high that considerable increase of the degree of the fibre orientation in the fibre sliver generated is achieved, and that the proportion of hooked fibres is substantially decreased. Notes pertaining to the drafting process before deposition of slivers can be found in the volume "Verkürzte Baumwollspinnerei (Abreviated Cotton Spinning)" by Prof. Dr. Ing. Walther Wegener-Mönchengladbach 1965. These notes are referred to in more detail in the following.

It is assumed that the draft ratio chosen is higher than 2, and preferably ranges between 3 and 6. This should additionally ensure that a fibre sliver of high quality structure is formed which beneficially influences in particular the subsequent processing steps.

In order to render feasible such a high draft ratio between the fibre sliver forming device and the sliver deposition or coiler device, the fibre sliver forming device preferentially should generate a fibre sliver of low finness (or high linear density respectively), e.g. of at least 8 ktex and preferably 10 ktex or even more (e.g. 12 ktex). In order to render this feasible, a relatively large working width of the card preferentially is chosen, e.g. exceeding 120 mm. This can be realized using a machine according to EP patent application No. 866 153. The whole contents of said EP application thus is incorporated and considered as an integral part of the present description.

Alternative solutions not requiring wide cards have been described in EP-1-627 509 and U.S. Pat. No. 5,535,488.

The linear density of the sliver after drafting system can be e.g. 3 to 5 ktex. The delivery speed at the delivery of the drafting system can e.g. exceed 400 m/min. Preferentially a drafting system of such type is provided arranged on the sliver depositing or coiler device (compare the volume "Verkürzte Baumwollspinnerei (Abreviated Cotton Spinning)" p. 72 and the CS-Patent 98 939 mentioned therein) in such a manner that the fibre sliver delivered by the drafting system is deposited as soon as possible (without being transported over a long path).

Further advantages of the present invention are described in more detail in the following with reference to illustrated design examples.

DETAILED DESCRIPTION OF THE PREFERRED EMBODIMENTS

Reference will now be made in detail to embodiments of the invention illustrated in the figures. Each embodiment is presented by way of explanation of the invention, and not as a limitation of the invention. For example, features illustrated or described as part of one embodiment may be used with another embodiment to yield still another embodiment. It is intended that the present invention include such modifications and variations.

Figure 1:
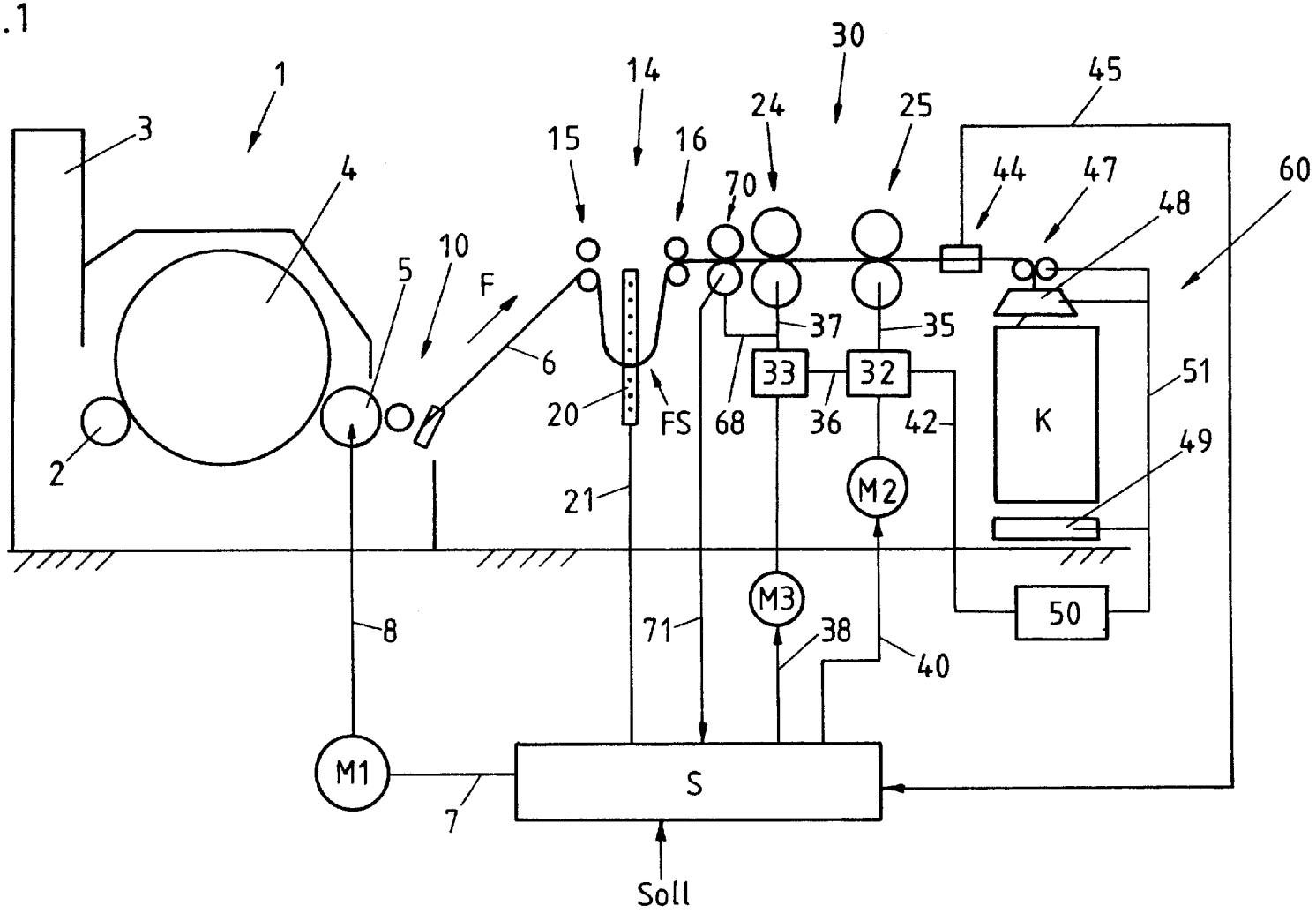
FIG. 1 a schematic view of an inventive arrangement.

In the FIG. 1 a card 1 is shown schematically which is supplied with fibre material via a feed chute 3 and via a feed roll 2 arranged adjacent to it. The fibre material is taken over by the main drum 4 and is processed in cooperation with carding elements not shown. The carded material is taken off the main drum 4 by a take-off roll 5 and is transferred to a take-off device 10 indicated schematically. From this take-off device 10 the fibre sliver 6 is transferred in the transporting direction F to a sag storage device 14 equipped with a pair of take-in rolls 15 and with a pair of delivery rolls 16. The degree of sliver sagging (fibre sliver loop FS) is scanned by a column-type sensor 20 provided with a series of sensors arranged along a column. Using this arrangement any position of the fibre sliver loop can be detected precisely. The sensor signals are transmitted via the circuit 21 to a control unit S.

From this control unit S the drive motor M1 of the take-off roll 5 is controlled via the control circuit 7.

The fibre sliver 6 delivered by the storage device 14 passes through a measuring device 70 which is laid out in the form of a pair of feeler rolls. The value measured by the measuring device 70 is transmitted via the circuit 71 to the control unit S. Upon passing through the measuring device 70 the fibre sliver is transferred to the drafting unit 30 formed by the pairs of rolls 24 and 25 between which it is drafted.

The base drive of the drafting unit 30 is effected by the Motor M2 which is controlled via the circuit 40 by the control unit S.

In practical application, the motor M1 of the take-off roll 5 in this arrangement is laid out as the leading or master motor to which the motor M2 is coordinated in its base rotational speed as a slave motor in such manner that predetermined drive conditions are maintained. This base rotational speed of the motor M2 can be overridden by the signals of the sensor 20 which is to be explained in more detail in the following.

The motor M2 drives a gear arrangement 32 from which a branch drive 35 extends to the delivery rolls 25 and a further branch drive 36 extends to a regulating gear arrangement (differential gear). From this regulating gear arrangement 33 the intake pair of rolls 24 is driven via the drive train 37.

The regulating actions required for levelling out mass variations (shorn and long term) according to the evaluation of the signals transmitted by the measuring device 70 in comparison with a pre-set desired value are effected by a regulating motor M3 which via a circuit 38 is controlled by the control unit S and which acts upon the regulating gear arrangement 33. Owing to this action the draft between the pairs of rolls 24 and 25 is changed and mass variations in the fibre sliver thus are leveled out.

The drive of the pair of measuring rolls 70 is effected via the drive train 68 which branches off from the drive path 37. In this manner, movement of the intake pair of rolls and the pair of measuring rolls 70 is synchronized.

Changes in the rotational speed of the intake pair of rolls 24 are acting backward, against the transporting direction F, and are taken up in the storage device 14 where the loop position FS is changed. Scanning the position of the sagging loop in this arrangement can be effected in steps in such a manner that if a certain amount of change is detected, overriding of the base rotational speed of the drive motor M2 is induced by the control unit S. Owing to this reduction, or increase respectively, in the base rotational speed, the effect of the change in rotational speed caused by the regulating action, particularly in levelling out long term mass variations, are compensated for. The size of the storage device thus can be kept to a minimum.

As soon as the rotational speed of the intake pair of rolls 24 increases, the sag of the sliver loop SF is reduced, the delivery speed of the take-off roll 5 remaining constant. This is scanned by the sensor 20 and correspondingly the base rotational speed of the motor M2 is lowered. Thus the rotational speed of the intake pair of rolls also is lowered, the adapted draft ratio in the drafting system 30 remaining constant, in such a manner that the fibre sliver loop is brought back to its original position.

The drive of the sliver deposition device or coiler 60 arranged subsequently is permanently coupled to the drive of the drafting system unit 30, namely via the drive train 42 which branches off from the gear arrangement 32 and is connected to a gear arrangement 50.

The calender rolls 47, the coiler gear 48 and the can turntable 49 are driven by the gear arrangement via the gear train 51 which is shown schematically.

Between the pair of rolls 25 and the pair of calender rolls 47 a further scanning sensor 44 is arranged which via the circuit 45 is connected with the control unit S. This arrangement serves for the final control of the linear density of the fibre sliver the machine being stopped if the linear density exceeds a predetermined tolerance field over a predetermined period of time.

The fibre sliver passes via the calender rolls 47 and via the coiler gear 48 is deposited in coils into a sliver can K which is rotated by the can turntable while the sliver is being deposited.

Figure 2:
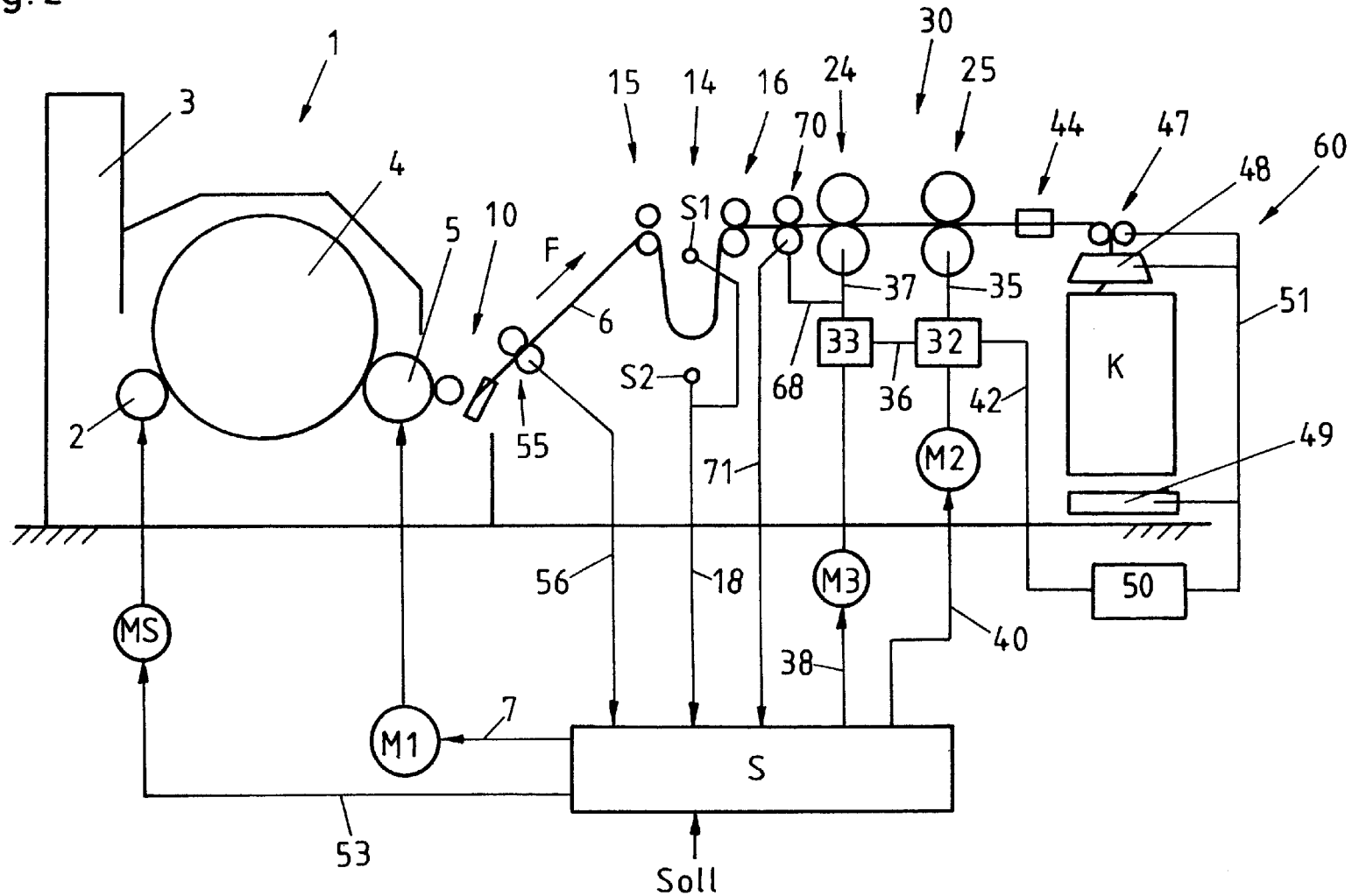
FIG. 2 a further embodiment according to FIG. 1.

In the FIG. 2 an arrangement is shown in which adjoining the take-off device 10 a pair of measuring rolls 55 is arranged which via the circuit 56 is connected with the control unit S. This measuring device 55 scans essentially the long term mass variations (drifting of the fibre sliver linear density). The signal given off by this measuring device 55 is compared to a preset desired value in the control unit S and a corresponding controlling signal is generated which is used for overriding the base rotational speed of the motor M2. Owing to this arrangement a subsequent regulating action in the drafting system 30 can be reacted on early for maintaining a constant level of the position of the fibre sliver loop in the storage device.

The storage device 14 in this arrangement is provided with two sensors S1 and S2 which are merely triggered only if the position of the fibre sliver loop FS exceeds predetermined tolerance limits. Such occurrences are caused by a disturbance, and the machine (plant) is switched off. The signal given off by the measuring device 55 additionally is used for regulating the drive motor MS of the feed roll of the card 1 for levelling out a drift in linear density already at the card. The motor MS is influenced by the control unit S via the circuit 53.

The further elements shown correspond to the ones in the design example described with reference to the FIG. 1 and thus are not discussed in more detail here.

Figure 3:
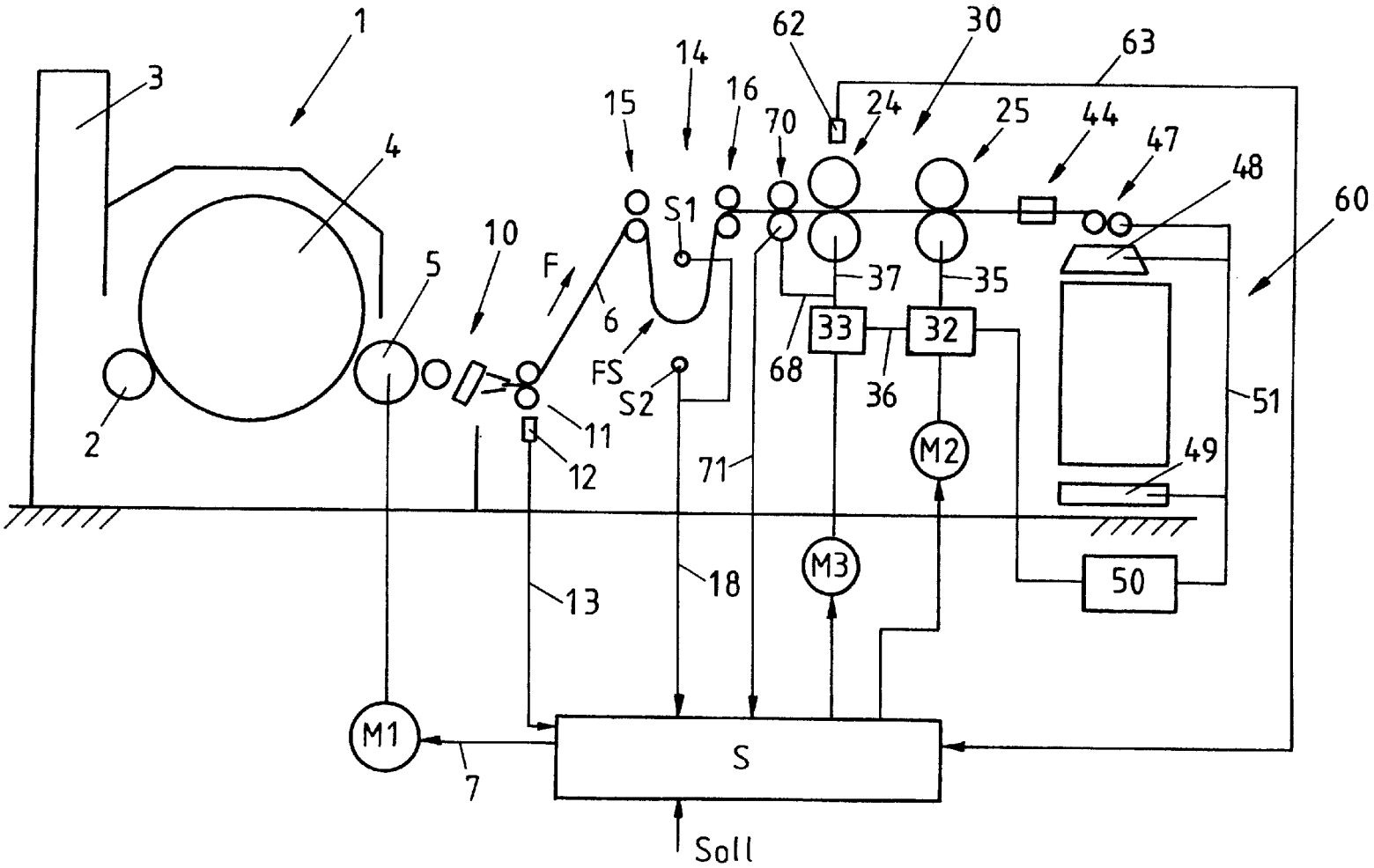
FIG. 3 an additional further embodiment according to FIG. 1.

In the FIG. 3 a further embodiment is shown in which a pair of take-off rolls 11 is arranged adjoining the take-off device 10. The rotational speed f this pair of rolls is monitored by a sensor 12. In this arrangement also a sensor 62 monitoring the rotational speed is coordinated to the pair of take-in rolls 24 of the drafting system 30 and is connected with the control unit S via the circuit 63.

The lay-out of the storage device 14 corresponds to the one described already for the embodiment according to the FIG. 2.

As long as no regulating action is required (unchanging linear density), the ratio of the rotational speed of said pairs of rolls (11, 24) remains constant. If drifting of the fibre sliver mass in one direction or in the other is detected by the measuring device 70, a regulating action is effected in such a manner that the rotational speed of the intake rolls 24 is adapted. Thus also the ratio of the rotational speeds of the pairs of rolls 11 and 24 changes owing to which a control signal is generated by the control unit S as a function of the change which changes, or overrides respectively, the base rotational speed of the drafting system 30, and of the motor M2 respectively, in such a manner that, as described for the arrangement with reference to FIG. 2, the regulating action is compensated for.

The further elements and control systems respectively, correspond to the embodiment according to the FIG. 1 and thus are not discussed again in more detail here.

The compensation for the regulating action, effected by overriding the base rotational speed of the drafting system 30, essentially concerns the long term mass variations only and not the short term ones which are not very important and, considered over time, level themselves out.

Figure 4:
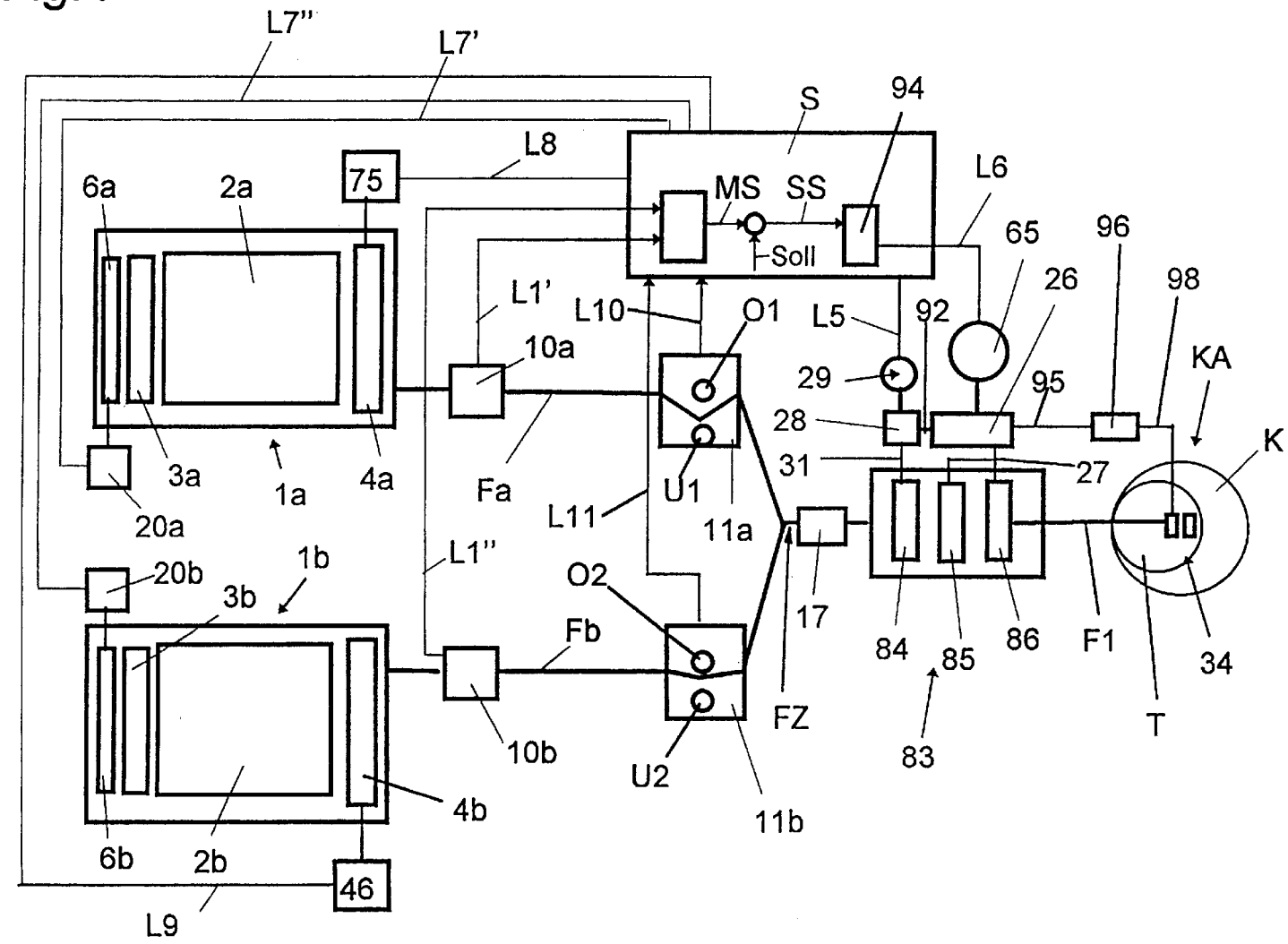
FIG. 4 a schematic top view of an arrangement with two cards according to the present invention, and in the FIG. 5 a schematic diagrammatic view of the mass of a card sliver produced plotted in combination of the diagram of the adapted rotational speed of the drafting system.
Figure 5:
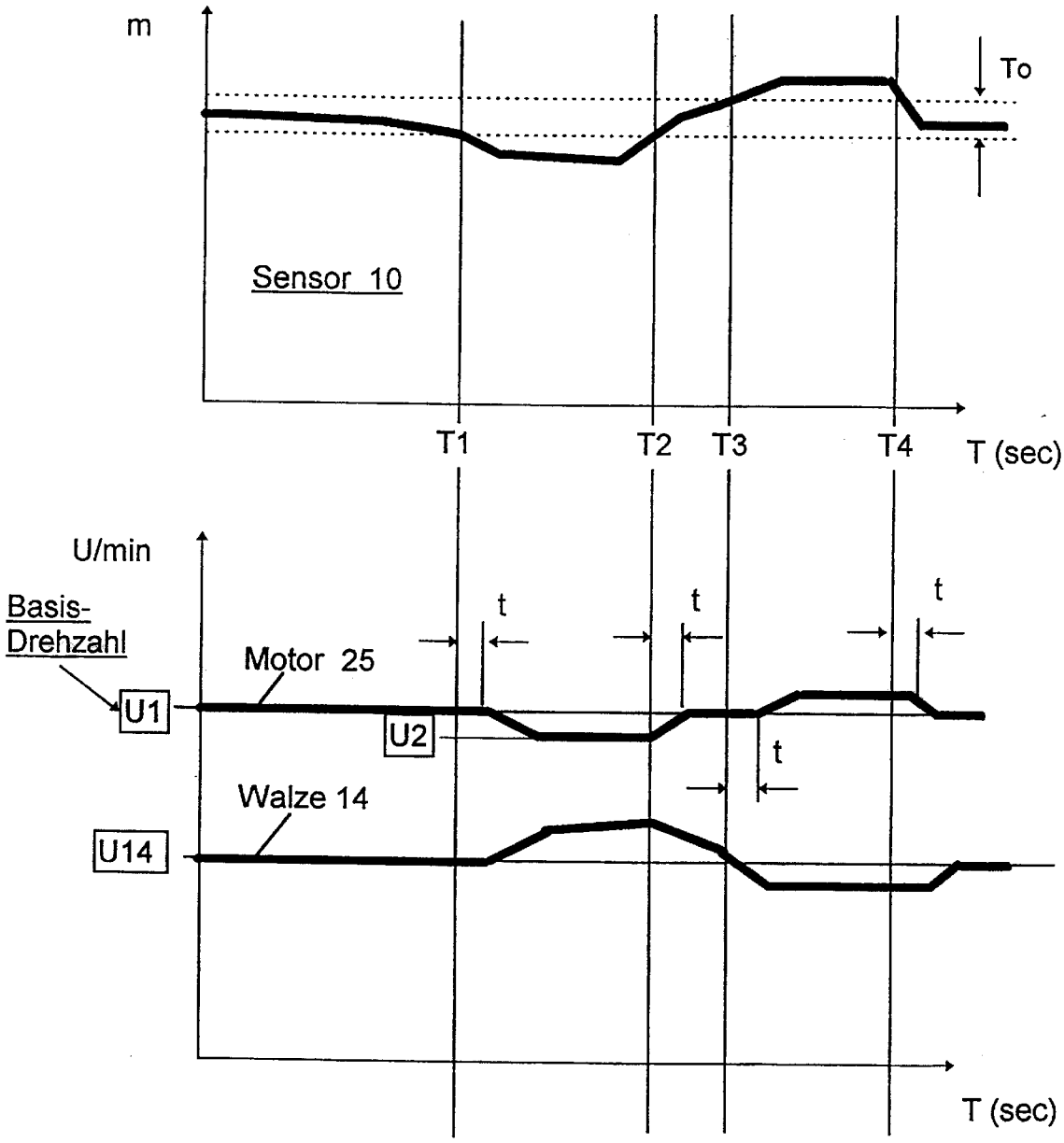

In the FIG. 4 an embodiment is shown in which two cards 1*a*, 1*b* are operating in parallel side by side. These cards also are equipped with feed rolls 6*a*, 6*b* and licker-in 3*a*, 3*b*, main drums 2*a*, 2*b* and take-off rolls 4*a*, 4*b*. The drive of the take-off rolls 4*a* and 4*b* is indicated schematically with 75, and 46 respectively, which are connected with the control unit S via a control L8, and L9 respectively. Also the drive 20*a*, and 20*b* respectively, of the feed rolls 6*a*, 6*b* are connected with the control unit S via the control circuits L7', and L7" respectively. In order to render feasible the coordination of the two cards 1*a*, 1*b*, the drive 46 of the take-off roll 4*b* operates as a slave of the drive 75 of the take-off roll 4*a* which operates as the master drive.

The fibre slivers Fa, and Fb respectively, delivered by the card 1*a*, and the card 1*b* respectively, each pass through a sensor device 10*a*, and 10*b* respectively, where their mass is scanned. Subsequently the fibre slivers Fa and Fb each are transferred into a sag storage device 11*a*, and 11*b* respectively. In these storage devices sensors O1, U1 and O2, U2 are arranged for scanning the filling level, or the amount of sagging of the fibre sliver loops. In this arrangement the sensors O1, O2 scan an upper position and the sensors U1, U2 a lower position of the fibre sliver loop. Between the respective upper sensor and the corresponding lower sensor the tolerance band extends within which the position of the fibre sliver loop can move freely without triggering a regulating action. Arrangement of a sensor for continuous scanning also could be envisaged. The sensors O1, U1 and O2, U2 are connected with the control unit S via the circuits L10, and L11 respectively.

Upon leaving the respective sliver storage devices 11*a*, 11*b* the two fibre slivers Fa and Fb are joined into one single fibre sliver FZ. This FZ subsequently is guided past a sensor 17 which scans the mass variations in the fibre sliver FZ. The fibre sliver FZ scanned by the sensor 17 subsequently is transferred into the regulating drafting system 83. The values measured by the sensor 17 are transmitted to the control unit S via a circuit (not shown).

The drafting system 83 in the example shown consists of three pairs of rolls 84, 85 and 86 arranged in series, in which arrangement the intake pair of rolls 84 is driven at a variable rotational speed for levelling out mass variations in the fibre sliver. The pair of delivery rolls 86 is driven by a main motor 65 and a gear train 26 arranged subsequently at a constant rotational speed. As indicated schematically by the drive train 27 also the intermediate pair of rolls 85 is driven at a constant rotational speed, the ratio of which to the rotational speed of the delivery rolls 86 arranged subsequently is constant. According to the pre-set ratio of rotational speeds, a constant draft is effected between the pair of rolls 85 and 86. The motor is controlled via an inverter 84 and via the circuit L6 connecting the control unit S and the motor 65. A differential gear 28 is driven via a drive train 92 and drives the pair of intake rolls 84 via the drive train 31. The drive of the differential gear 28 can be overridden by a regulating motor 29 which is controlled via an inverter (not shown) and via the circuit L5 from the control unit S. This overriding is effected based on the signals transmitted from the sensor 17 which are compared to a desired value pre-set in the control unit S.

Downstream from the regulating drafting system 83 a sliver depositing device or coiler is arranged using which the fibre sliver F1 delivered by the drafting system, after passing through a pair of calender rolls 34 and a coiler gear T, is deposited in a sliver can K The can K in this arrangement is placed on a driven can turntable (not shown) which rotates the can during the filling process. The can turntable, the calender rolls 34 and the coiler gear are driven via the drive train 98 by a gear arrangement 96. The gear 96 in turn is driven via the permanent drive connection of the gear arrangement 26, shown schematically, which is driven by the main motor 65. From this arrangement it can be seen that the pair of delivery rolls 86 is permanently coupled with the drive elements of the sliver depositing device or coiler KA directly via the gear arrangement 26. This signifies that if the gear arrangement 26 is driven at a lower speed by the motor 65 the base rotational speed of the pairs of rolls 84, 85 and 86 is lowered and also at the same time the rotational speed of the calender rolls 34, of the coiler gear T and of the can turntable of the sliver depositing or coiler device KA.

As indicated schematically, a mixed signal MS is generated from the signals obtained from the sensors 10*a* and 10*b* in the control unit S which is compared to a pre-set desired value. The control signal SS resulting from this comparison is applied for influencing the pre-set base rotational speed of the motor 65. In the following the function modes of the device is discussed in more detail:

At the beginning of the processing (start-up phase) the base rotational speed of the drafting system is coordinated, or adapted respectively, to the rotational speed of the take off roll 4*a*. Only after the nominal operating speed is attained, the process of overriding the base rotational speed becomes operable. The fibre slivers Fa and Fb supplied by the cards 1*a* and 1*b* are scanned by the sensors 10*a* and 10*b* and the corresponding measured values (mass) are transmitted to the control unit S where a mixed signal MS is generated. This mixed signal is compared to a preset desired value from which comparison a control signal results if the value measured deviates from the pre-set value. This control signal is transmitted to an inverter 94 which via the circuit L6 adapts the rotational speed of the motor 65 and thus also adapts the base rotational speed of the drafting system unit as well as of the sliver depositing or coiler device KA.

It is to be noted that the long term mass deviations measured by the sensors 10*a* and 10*b* at the same time also are used for controlling the drive of the drive arrangements 20*a* and 20*b* of the feed rolls 6*a* and 6*b* of the cards 1*a*, 1*b*. The drive arrangements here are connected to the control unit S via the circuits L7' and L7".

Upon leaving the sensors 10*a* and 10*b* the fibre slivers Fa and Fb are transferred into the storage devices 11*a* and 11*b* in which the slivers can sag and where they are scanned by the sensors O1, O2, and U1, U2 respectively. If the respective fibre sliver loop is located between the upper and lower the sensor, no additional control impulse is generated. As soon as, e.g., the sensor U2 indicates that the loop formed by the fibre sliver Fb is sagging too much, the direct co-ordination of the drive 46 of the take-off roll 4*b* is overridden by the drive 75, which acts as the master drive, and rotational speed of the roll 4*b* is reduced. As after this action the fibre sliver loop moves back into the tolerance band between O2 and U2, the control coupling between the drives 65 and 46 is deactivated again. If the fibre sliver loop does not return into the tolerance band, a disturbance must have occurred, and the whole system is shut off.

Similarly the control action is effected in the storage device 11*a* in which arrangement, if the fibre sliver loop is located outside the tolerance band between the sensors U1 and O1 over too long a time period, the system is switched off as occurrence of a disturbance is to be assumed.

The fibre slivers leaving their respective storage devices are joined into a common fibre sliver FZ before entering a measuring device 17 arranged subsequently.

In the measuring device 17 the mass variations are measured and the corresponding signal is transmitted via the circuit 3 to the control unit S. Based on a comparison of the measured value and the pre-set desired value, a corresponding signal is transmitted via the circuit L5 to the regulating motor 29 which via the regulating gear arrangement 28 adapts the rotational speed of the intake rolls 84 for levelling out the mass variations. Thus the draft between the pairs of roll 84 and 85 is changed. The draft between the pairs of roll 85 remains constant.

The fibre sliver F1 drafted in the manner described is delivered by the drafting system unit and via the calender rolls 34 and the coiler gear T is coiled into a can K.

For the structure of the fibre arrangement in the sliver it proves advantageous if the total draft applied is chosen greater than 3, as the trailing fibre hooks generated in the take-off process of the fibres on the card are straightened out partially in the drafting process which beneficially influences the subsequent processing steps.

By pre-controlling the base rotational speed of the drafting system unit, effects caused by a later regulating action at the drafting system unit can be compensated for ahead of time in such a manner that the regulating action, in particular for levelling out long term mass deviations, is to be taken care of not just by the respective fibre sliver storage device only. Thus over-sized lay-out of the fibre sliver storage device can be dispensed with. This compensation is discussed in more detail in the following with reference to the FIG. 3:

Starting out from a base or operating rotational speed U1, at the time moment T1 a drift is detected by means of the sensors 10*a*, 10*b* of the measured value of the mass m exceeding the tolerance band To. If the drift of the mass m at the time moment T1 would occur without any action influencing the base rotational speed the process would develop as follows: Due to the lower mass supplied to the drafting system 83 the draft between the pairs of rolls 84 and 85 must be reduced. This signifies that the rotational speed of the pair of take-in rolls 84 is increased via the regulating motor 29 and the differential gear; and correspondingly the draft between the pairs of rolls 84 and 85 is reduced as the rotational speed of the pair of rolls 85 remains constant. Due to the reduction of the rotational speed of the intake pair of rolls 84, also the input speed of the fibre sliver F supplied is diminished. As the card, or the take-off roll respectively, is driven at constant speed, the original delivery speed of the fibre sliver from the card remains constant. The difference thus created between the delivery speed of the card and the changed intake speed of the fibre sliver at the drafting system 83 is taken care of by the fibre sliver storage device 11*a*, and 11*b* respectively. This signifies the excess amount of fibre sliver F fills the fibre sliver storage device 11*a*, and 11*b* respectively, until the same ratios between the delivery speed at the card and the intake speed at the drafting system again are prevailing. Such levelling than can be effected again as soon as the regulating action at the feed roll 6*a*, 6*b* exerts its influence at the card delivery. If these mass deviations occur alternatively upward, and downward respectively, the filling level of the sliver storage devices 11*a*, 11*b* is not influenced much. The sliver storage devices 11*a*, 11*b* must offer sufficient capacity. If however, these mass deviations occur at regular intervals or at random intervals and essentially in one the same direction, the capacity of the buffer storage device 11*a*, 11*b* soon reaches its limits.

In order to avoid these disadvantages and in order to keep the capacity of the sliver storage device to a minimum, an action, as claimed according to the present invention, on the base rotational speed of the base motor 65 is effected. As soon as, e.g. at a moment in tie T1, the mass deviation detected by the sensors 10*a*, 10*b* exceeds a pre-set tolerance band To also the rotational speed of the motor 65 is adapted after a time lag t. From the upper diagram it can be seen that the mass diminishes and correspondingly the draft in the drafting system 83 is to be reduced also which is effected by an increase of the rotational speed of the pair of intake rolls 84. If now, as shown in the lower diagram according to the FIG. 3, the base rotational speed of the motor 65 is lowered to U2, the increase in rotational speed relative to the pair of rolls 85, effected via the regulating motor 29, is compensated for almost completely. This can be seen in particular from the two lower curves shown in the FIG. 3, the lower curve showing the change in rotational speed of the pair of intake rolls 84 relative to a constant rotational speed of the pair of rolls 85. It can be seen from this illustration that the decrease in mass detected in the fibre sliver delivered at the time moment T1 by the sensors 10*a*, 10*b* causes an increase in the rotational speed U14 of the roll 84 relative to the roll 85 in such a manner that this thin place is levelled out by reducing the draft. If the fibre sliver loop still is located within a predetermined tolerance band, no additional control signal for further influencing the base rotational speed is generated. By simultaneously reducing the base rotational speed U1 of the motor 65 this change in rotational speed of the roll 84 is compensated for approximately, i.e. the rotational speed level of the drafting system 83 as a whole is lowered evenly owing to the drive co-ordination in such a manner that in spite of the change in the ratio of the rotational speeds between the pairs of rolls 84 and 85 the current rotational speed of the pair of intake rolls is re-established at about the value which had prevailed before the regulating action.

Owing to this arrangement it is rendered feasible that the intake speed of the fibre sliver FZ also remains at about the same level. Owing to this arrangement the fibre sliver storage devices 11*a*, 11*b* are levelling out short term regulating actions whereas the long term deviations are leevelled out by changes in the base rotational speed of the motor 65. The sensors U1, O1, U2, O2 in this arrangement serve as an additional auxiliary monitoring device. For better clarity of the diagram in the curve of the roll 94 illustration of the peaks caused by short term regulating action was dispensed with. Such short period regulating actions as a rule oscillate up and down about the curve shown.

Due to the lowering of the base rotational speed also the rotational speeds of the drive elements of the sliver depositing or coiler device are lowered synchronuously in such a manner that the ratio of rotational speeds between the delivery roll 86 and the calender rolls 34 is maintained constant. This off-setting of the long term drifts in the fibre mass can be effected relatively gently and slowly in such a manner that coordinating the rotational speeds of the relatively inert elements of the sliver depositing or coiling device KA does not present problems.

Using the proposed arrangement, on one hand long term deviations in the fibre mass can timely be reacted on with the help of sensor devices known already and on the other hand the fibre sliver storage device required for the regulation at the intake side of the drafting system can be kept to minimum capacity.

A further aspect of the present invention concerns the improvement of the degree of fibre orientation, and the reduction in the number of hooked fibres (fibre hooks) in the card sliver. The term "card sliver" in this context signifies a fibre sliver delivered to a sliver depositing or coiler device arranged downstream from the card.

The importance of the degree of fibre orientation and the problems arising from the occurrence of fibre hooks in the card have been described in the volume "Verkürzte Baumwollspinnerei; Faserband-Spinnverfahren" (Abreviated Cotton Spinning; Fibre Sliver Spinning"), 1965, edited by "Zeitschrift für die gesamte Textilindustrie" ("Review of the Textile Industry") authored by Prof. Dr. W. Wegener and Dr. H. Peuker (pages 82 ff, compare pages 87 through 97 in particular). From this study it becomes clear that application of a drafting system for improving the degree of fibre orientation in case slivers is known (Pages 87/88: Chapter "Kardenband-Verzugsaggregate" ("Card Sliver Drafting Device"), compare also page 72—"Graf-Optima Kardenbvand-Verfleichmässigungsaggregat" ("Graf-Optima Card Sliver Evener Device")). In the meantime further proposals for application of a drafting system at the card delivery have been published (See e.g. among others U.S. Pat. No. 4,100,649; U.S. Pat. No. 3,703,023; Textile Asia, June 1989, p.20; CH-C-462'682; U.S. Pat. No. 4,768,262; U.S. Pat. No. 5,152,033; U.S. Pat. No. 4,947,947; U.S. Pat. No. 5,400,476; U.S. Pat. No. 5,274,883; U.S. Pat. No. 5,018,248; DE-A-2'230'069; EP-A-512'683). An original Japanese Publication (JP OS 51-29529 published 1976; Applied for by Fuji Seiko KK) describes a drafting system on the card performing a drafting process applying a draft ratio ranging from 1.1 to 2.

Since the publication of the volume cited above, interest in the application of direct card sliver spinning processes (without intermediate drawframe passages) has spread further as a spinning method of such type has been favoured by the success of the rotor spinning method (from 1970 on)—compare DE-A-4'041'719. A newer proposal in this direction can be found also in EP-A-544'426 where a draft ratio ranging from 6 to 8 is proposed, and even higher draft ratios (12 or even 30) are mentioned. Notwithstanding such proposals direct card sliver spinning (without a drawframe passage) thus far has not been accomplished successfully, even using the rotor spinning process.

Expressed in other words, it is known up to now that a card sliver is deposited (in a can), and to take off the fibre sliver at least once (from a can) and draft it in order to improve the degree of the fibre orientation, whereupon the fibres (possibly upon further processing steps) can be spun. In such drafting processes, no overall reduction in linear density of the material creeled is aimed at—e.g. six fibre slivers being joined into a web which subsequently is subject to a draft of six.

The second aspect of the present invention provides a method of forming a card sliver, where a card web is condensed into a fibre sliver, the fibre sliver is drafted and the drafted sliver is deposited, characterized in that the fibre sliver in the drafting process is subject to a draft high enough to significantly increase the degree of the fibre orientation, and to lower the proportion of hooked fibres substantially.

This aspect of the present invention provides a corresponding apparatus with a drafting system to be arranged between the sliver forming device and the sliver depositing or coiler device of a card, characterized in that the drafting system can generate a draft high enough in such manner that the degree of fibre orientation is significantly increased, and the proportion of hooked fibres is substantially lowered.

In particular the fibre sliver drafting process (e.g. by means of said drafting system) being performed before the depositing process can be used for reducing the proportion of trailing hooks significantly (compare the volume "Verkürzte Spinnerei" (Abreviated Spinning"), page 90).

For the purpose mentioned, it proves advantageous to subject the fibre sliver to a draft at a draft ratio exceeding 2 and preferentially exceeding 3. If possible, a draft ration of 5 to 6 should be applied which, however, rarely can be realized between the card delivery and the subsequent sliver depositing or coiler device without causing disturbances in the running properties of the fibre sliver.

In order to render such high draft ratios feasible between the sliver forming device and the sliver depositing or coiler device, the sliver forming device preferably should generate a fibre sliver of high linear density (great mass), e.g. of at least 9 ktex and preferentially of 10 ktex or even more (e.g. 12 ktex). In order to achieve this, cards, of a relatively large working width preferentially are applied, of e.g. of more than 1200 mm. This can be achieved using a machine according to our EP-Patent Application No. 98'810'088.9. The complete contents of said EP-Application thus is considered an integral part of the present description. The EP-Application very probably will be published on Sep. 23, 1998 under the No. 86'153.

Alternative solutions not requiring large cards have been described in EP-A-627'509 and U.S. Pat. No. 5,535,488.

The linear density of the sliver after the drafting system can be e.g. 3 to 5 ktex. The delivery speed of the drafting system can e.g. exceed 400 m/min. Preferentially a drafting system of such type is arranged on the sliver depositing or coiler device (Compare the volume "Verkürzte Baumwollspinnerei (Abreviated Cotton Spinning"), page 72 and the patent CS-98'399 mentioned therein) in which arrangement the fibre sliver delivered by the drafting system can be deposited as soon as possible (without passing along an extended transporting path).

The second aspect of the present invention correspondingly provides a method according to which a card web is condensed into a fibre sliver and is drafted, a draft of at least 2 and preferentially of more than 3 being applied before the sliver is deposited.

Expressed in other words the present invention under this aspect provides a card with a fibre sliver forming device, a sliver depositing or coiler device and with a drafting system for generating a draft higher than 2 and preferentially higher than 3.

The drafting system can be laid out as an evening aggregate, i.e. it can be laid out for generating a controlled variable draft which, however, is not of vital importance for the present invention. Changes in the draft ration will cause corresponding changes in the degree of fibre orientation. The card itself thus advantageously can be laid out as an evening aggregate (e.g. according to EP-A-271'115) in which arrangement the adjoining drafting system is conceived for enhancing the degree of fibre orientation.

A regulating drafting system according to the second aspect of the present invention preferentially is laid out for a total draft GV (between the pair of intake rolls and the pair of delivery rolls) of more than 2 and preferably of 3 to 6. If the drafting system is not provided with a pre-drafting zone, which is not relevant for the present invention, the average draft in the regulated (variable) drafting zone can be e.g. about 2.5, and the draft applied in the other (constant) drafting zone can be e.g. about 1.1 to 1.5 and the "main draft" (in the second, variable draft zone) can be about 2.0 to 4.

The linear density of the fibre sliver delivered from the drafting system preferentially is in the range of 3 to 5 ktex. The drafting system is arranged preferentially directly above the coiler gear of a sliver depositing or coiler device, e.g. as shown in DE-Gbm-296 22 293. The fibre sliver deposited into the can can be supplied directly, e.g. according to EP-A-627 509, to the open end spinning machine.

The second aspect of the present invention preferentially (but not necessarily) is applied in combination with the other characteristics, described in the introduction, of the present invention.

What is claimed is:

1. A system for leveling out mass variations in a fiber mass, said system comprising:

a textile processing machine configured to supply the fiber mass with a supply device at a generally constant supply speed;

a regulated drafting system disposed downstream from said processing machine, said drafting system comprising at least two sets of driven rolls defining a draft zone therebetween, at least one of said sets of rolls being regulated for varying the draft of said drafting system;

a drive operatively coupled to said drafting rolls, said drive coordinated with said supply drive so as to drive said drafting rolls at a base rotational speed that is a relatively constant function of said supply speed;

a control unit configured with said drive for adjusting the rotational speed of said regulated drafting rolls relative to said base rotational speed to change the draft of said drafting system;

means operatively configured with said control unit to detect at least one regulating parameter acted upon by said drafting system; and wherein said control unit subsequently readjusts said base rotational speed as a function of the detected regulating parameter so as to maintain a desired differential between a rate of supply of fiber material from said textile processing machine and a rate of processing by said drafting system.

2. The system as in claim 1, wherein said detecting means comprise sensors disposed to detect a delivery speed of said supply device and an intake speed of said drafting rolls, said sensors in communication with said control unit wherein said control unit is configured to compute a differential between said delivery speed and said intake speed and to adjust said base rotational speed based upon said differential.

3. The system as in claim 2, wherein said detecting means further comprises a fiber sliver storage device disposed between said textile processing machine and said drafting system, said storage device further comprising a sensor configured to detect an amount of fiber sliver stored in said storage device.

4. The system as in claim 3, wherein fiber sliver storage device comprises a fiber sag storage device configured to store a fiber sliver loop.

5. The system as in claim 4, wherein said sensors detect whether a fiber loop within said storage device is within pre-set tolerance limits.

6. The system as in claim 1, wherein said detecting means comprises a fiber mass sensor disposed upstream of said drafting system to detect long term mass deviations of the fiber material supplied to said drafting system, said control unit adjusting said base rotational speed as a function of the detected fiber mass compared to a preset fiber mass value.

7. The system as in claim 6, wherein said measuring device is disposed between said textile processing machine and said drafting system.

8. The system as in claim 7, wherein said textile processing machine is a card machine.

9. The system as in claim 8, wherein said card machine comprises a feed device, said measuring device also providing input for regulation of said card machine feed device.

10. The system as in claim 1, further comprising a pair of transport rolls disposed between said textile processing machine and said drafting system, said detecting means comprising a sensor disposed to sense rotational speed of said transport rolls and a sensor disposed to sense rotational speed of said drafting system regulated rolls, said control unit computing long term mass deviations in said fiber material as a function a ratio of said rotational speeds.

11. The system as in claim 1, wherein said textile processing machine comprises at least two card machines configured to separately supply a fiber sliver to said drafting system, each of said card machines having independent driven delivery devices wherein the speed of one said delivery device is slaved to the speed of the other said delivery device, said detecting means comprising sensors disposed to detect fiber mass of each of the fiber slivers from said card machines, said sensors in communication with said control unit wherein the separate detected fiber masses are combined into a common fiber mass value which is acted upon by said control unit to adjust said base rotational speed based upon a difference between said common fiber mass value and a pre-set desired mass value.

12. The system as in claim 11, further comprising a fiber sliver storage device disposed between each of said card machines and said drafting system.

13. The system as in claim 12, wherein each of said fiber sliver storage devices comprises a sensor configured to detect an amount of fiber sliver stored in said respective storage device.

14. The system as in claim 13, wherein said fiber sliver storage devices comprises a fiber sag storage device configured to store a fiber sliver loop.

15. The system as in claim 13,wherein the speed of said delivery devices is adjusted based upon a level of fiber sliver in said storage device associated with said slaved delivery device.

16. The system as in claim 1, further comprising a fiber sliver depositing device disposed downstream from said drafting system, and wherein said drafting system is configured to generate a total draft of at least 2 upon the fiber sliver prior to the sliver being deposited into a storage container by said sliver depositing device.

17. The system as in claim 16, wherein said textile processing machine is a card machine and said sliver depositing device comprises a coiler device, said drafting system disposed operably between a delivery end of said card machine and said coiler device.

18. The system as in claim 17, wherein said drafting system is configured to generate a total draft of between about 3 to about 6.

19. The system as in claim 18, wherein said drafting system is configured to have a delivery speed of at least about 400 m/min.

20. The system as in claim 17, wherein said drafting system is operably disposed on said coiler device.

21. The system as in claim 1, wherein said textile processing machine comprises a card machine configured to produce a fiber sliver having a linear density of at least 8 ktex.

22. The system as in claim 21, wherein said card machine has a working width of at least about 1200 mm.

* * * * *